United States Patent [19]

Gerber et al.

[11] 4,353,977

[45] Oct. 12, 1982

[54] METHOD FOR FORMING A PHOTOSENSITIVE SILVER HALIDE ELEMENT

[75] Inventors: Arthur M. Gerber, Boston; Warren D. Slafer, Arlington; Vivian K. Walworth, Concord, all of Mass.

[73] Assignee: Polaroid Corporation, Cambridge, Mass.

[21] Appl. No.: 298,639

[22] Filed: Sep. 2, 1981

[51] Int. Cl.[3] ..... G03C 1/02; G03C 1/90; G03C 11/22

[52] U.S. Cl. ..... 430/256; 430/258; 430/262; 430/564; 430/567; 430/568; 430/569; 430/945; 430/948; 430/496; 427/180; 156/231; 156/232

[58] Field of Search ..... 430/564, 567, 568, 569, 430/945, 948, 496, 256, 258, 262, 263

[56] References Cited

U.S. PATENT DOCUMENTS 3,320,069 5/1967 Illingsworth et al. ..... 430/603
4,046,576 9/1977 Terwilliger et al. ..... 430/569
4,150,994 4/1979 Maternaghan ..... 430/567

OTHER PUBLICATIONS

Duffin, "Photographic Emulsion Chemistry," 1966, p. 59.
Whitmore, WO80/01614, published Aug. 7, 1980.

*Primary Examiner*—Mary F. Downey
*Attorney, Agent, or Firm*—Philip G. Kiely

[57] ABSTRACT

A photosensitive silver halide element comprising a support carrying photosensitive silver halide grains in a predetermined spaced array is prepared by a method which comprises at least partially coalescing fine-grain silver halide in a plurality of spaced depressions in a hydrophobic layer, superposing said layer with a hydrophilic layer during or subsequent to said coalescence, and then separating said hydrophilic layer and said hydrophobic layer whereby said coalesced silver halide grains are retained on said hydrophilic layer in a pattern corresponding substantially to the pattern of said spaced depressions.

51 Claims, 4 Drawing Figures

1 μm

1μm

1μm

1μm

METHOD FOR FORMING A PHOTOSENSITIVE SILVER HALIDE ELEMENT

BACKGROUND OF THE INVENTION

In the formation of photosensitive silver halide emulsions, the physical ripening or growing step during which time the silver halide grains increase in size is considered important. During the ripening stage an adequate concentration of a silver halide solvent, for example, excess halide, generally bromide, is employed which renders the silver halide much more soluble than it is in pure water because of the formation of complex ions. This facilitates the growth of the silver halide grains. While excess bromide and ammonia are the most common ripening agents, the literature also mentions the use of water-soluble thiocyanate compounds as well as a variety of amines in place of bromide. See, for example, *Photographic Emulsion Chemistry,* G. F. Duffin, The Focal Press London, 1966, page 59.

The art has also disclosed the employment of a water-soluble thiocyanate compound during the formation of the grains, that is, during the actual precipitation of the photosensitive silver halide. For example, U.S. Pat. No. 3,320,069 discloses a water-soluble thiocyanate compound which is present as a silver halide grain ripener either during precipitation of the light-sensitive silver halide or added immediately after precipitation. The precipitation of the silver halide grains in the aforementioned patent is carried out, however, with an excess of halide.

U.S. Pat. No. 4,406,576 is directed to a method for the continuous formation of photosensitive siliver halide emulsions wherein a silver salt is reacted with a halide salt in the presence of gelatin to form a photosensitive silver halide emulsion and said formation takes place in the presence of a sulfur-containing silver halide grain ripening agent, such as a water-soluble thiocyanate compound, and the thus-formed silver halide emulsion is continuously withdrawn from the reaction chamber while silver halide grain formation is occurring. During precipitation the halide concentration in the reaction medium is maintained at less than 0.010 molar. The patent states that is is known in the art to prepare silver halide grains in the presence of an excess of silver ions. The patent relates to such a precipitation with the additional steps of continually adding the sulfur-containing ripening agent and continually withdrawing silver halide grains as they are formed.

U.S. Pat. No. 4,150,994 is directed to a method of forming silver iodobromide or iodochloride emulsions which are of the twinned type which comprises the following steps:

(a) forming a monosized silver iodide dispersion;

(b) mixing in the silver iodide dispersion aqueous solutions of silver nitrate and alkali or ammonium bromides or chlorides in order to form twinned crystals;

(c) performing Ostwald ripening in the presence of a silver solvent, such as ammonium thiocyanate, to increase the size of the twinned crystals and dissolve any untwinned crystals;

(d) causing the twinned crystals to increase in size by adding further aqueous silver salt solution and alkali metal or ammonium halide; and (e) optionally removing the water-soluble salts formed and chemically sensitizing the emulsion.

Copending application of Arther M. Gerber, Ser. No. 194,561, filed Oct. 6, 1980 (commonly assigned) is directed to a method for forming narrow grain size distribution silver halide emulsions by the following steps:

1. Forming photosensitive silver halide grains in the presence of a water-soluble thiocyanate compound with a halide/silver molar ratio ranging from not more than about 5% molar excess of halide to not more than about a 25% molar excess of silver; and 2. Growing said grains in the presence of said water-soluble thiocyanate compound for a time sufficient to grow said grains to a predetermined grain size distribution.

Copending application of Edwin H. Land, Ser. No. 234,937, filed Feb. 17, 1981, (commonly assigned) is directed to a method for forming a predetermined spaced array of sites and then forming single effective silver halide grains at said sites. Thus, by forming the sites in a predetermined spatial relationship, if the silfver halide grains are formed only at the sites, each of the grains will also be located at a predetermined and substantially uniform distance from the next adjacent grain and their geometric layout will conform to the original configuration of the sites.

The term, "single effective silver halide grain," refers to an entity at each site which functions photographically as a single unit which may or may not be entire unit can participate in electronic and ionic processes such as latent image formation and development.

Copending application Ser. No. 234,937 discloses one method for forming sites by exposing a photosensitive material to radiation actinic to said photosensitive material and development the so-exposed photosensitive material to provide sites for the generation of silver halide corresponding to the pattern of exposure and then forming photosensitive silver halide grains at the sites. In a preferred embodiment, the sites are provided by the predetermined patterned exposure of the photoresist whereby upon development of the exposed photoresist a relief pattern is obtained wherein the peaks or valleys comprise the above described sites.

While the single effective silver halide grains may be formed employing the described photoresist relief pattern, it is preferred to replicate the relief pattern by conventional means, example, by using conventional electroforming techniques to form an embossing master from the original relief image and using the embossing master to replicate the developed photoresist pattern in an embossable polymeric material.

Copending application of Arthur M. Gerber, Ser. No. 298,640 filed concurrently herewith, (common assignee) is directed to a method for forming a photosensitive element comprising a plurality of single effective silver halide grains, which method comprises coalescing fine-grain silver halide in a plurality of predetermined spaced depressions. Preferably, the coalescence is effected by contacting fine-grain silver halide with a solution of a silver halide solvent.

Copending application of Edwin H. Land and Vivian K. Walworth, Ser. No. 298,638, filed concurrently herewith, (common assignee) is directed to a method of forming a photosensitive element comprising a plurality of single effective silver halide grains, which method comprises coalescing a fine-grain emulsion in a plurality of predetermined spaced depressions by contacting said fine-grain emulsion with a solution of a silver halide solvent containing a dissolved silver salt.

SUMMARY OF THE INVENTION

A photosensitive silver halide element comprising a support carrying photosensitive silver halide grains in a predetermined spaced array is prepared by a method which comprises at least partially coalescing fine-grain silver halide in a plurality of spaced depressions in the surface of a hydrophobic layer wherein a hydrophilic layer is superposed on said hydrophobic layer during or subsequent to said coalescence. Upon separation of the hydrophilic layer and the hydrophobic layer, silver halide grains are retained on said hydrophilic layer in a pattern corresponding substantially to the pattern of said depressions. Preferably, the fine-grain silver halide is coalesced to a single effective silver halide grain.

DETAILED DESCRIPTION OF THE INVENTION

Figure 1:
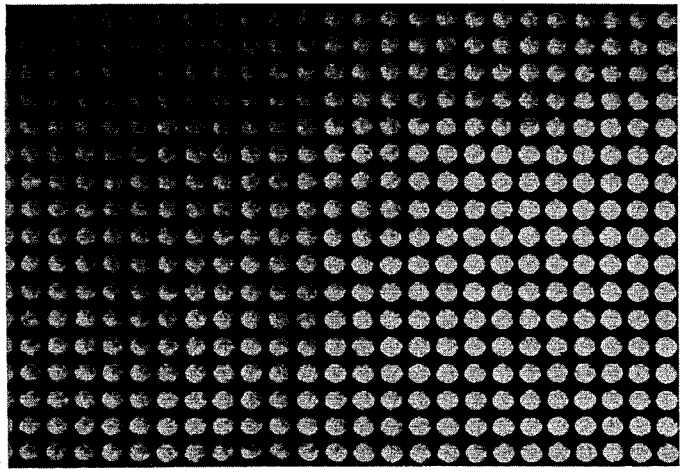
FIG. 1 is an electron micrograph at 2,000× magnification showing a photosensitive element prepared in accordance with the present invention.

The present invention is directed to a method for forming a photosensitive element comprising a support carrying photosensitive silver halide grains in a predetermined spaced array which comprises the steps of 1. at least partially coalescing fine-grain silver halide in a plurality of depressions in a hydrophobic layer
2. superposing a hydrophilic layer over said hydrophobic layer and
3. separating said hydrophobic layer from said hydrophilic layer whereby silver halide grains are affixed to said hydrophilic layer in a pattern corresponding substantially to the pattern of said spaced depressions.

Preferably, the fine-grain silver halide is coalesced to single effective grains and said single effective grains are affixed to said hydrophilic layer.

As used herein the terms "hydrophobic" and "hydrophilic" are intended to be defined relative to each other. Thus, it is only essential that the surface carrying the spaced depressions be more hydrophobic than the layer superposed thereon.

In one embodiment the present invention is directed to a method for coalescing fine-grain silver halide as a silver halide emulsion or binder-free silver halide in predetermined spaced depressions in a hydrophobic layer into a single effective silver halide grain in each depression and, subsequent to said coalescence, transferring said single effective grains to a hydrophilic polymeric layer. In this embodiment, during coalescence the spaced depressions containing the fine-grain silver halide emulsion and solution of silver halide solvent are temporarily laminated to a second hydrophobic layer. Subsequent to coalescence, the second hydrophobic layer is then separated from contact with the hydrophobic layer containing the depressions. The thus-formed single effective grains can be treated in various ways in situ, e.g., washed, sensitized and the like. In a second lamination, the grains and a hydrophilic layer on a separate support are then superposed and a liquid deposition therebetween. Upon separation the thus-formed single effective silver halide grains are transferred onto the hydrophilic layer from the depressions where they had been formed. The liquid may comprise water or a solution of a polymeric thickener, such as gelatin.

In an alternative embodiment, superposing the hydrophilic layers over the hydrophobic layer containing the spaced depressions with the fine-grain emulsion therein is substantially contemporaneous with coalescence. Thus, single effective grain formation occurs while the hydrophilic polymeric layer is in place over the depressions, and upon separation, the single effective grains are affixed to the hydrophilic layer.

In either of the above embodiments, the fine-grain silver halide may be only partially coalesced, i.e., single effective grains are not formed, but rather a plurality of subunits are formed in some or all of the depression.

For convenience the term "superposed" is intended to include combining the hydrophobic and hydrophilic layers with either layer being the top-most layer as well as combining the layers in a vertical arrangement.

As described in applications Ser. Nos. 298,640 and 298,638 a fine-grain silver halide emulsion is applied to predetermined spaced depressions in a manner that results in substantially all of the applied emulsion being contained in the aforementioned depressions with little being located on the planar or plateau-like surface of the patterned substrate between the depressions. The spaced depressions comprise a relief pattern in a layer of hydrophobic material.

In spite of the hydrophobic nature of the spaced depressions, the emulsion is deposited and retained in said depressions prior to and during coalescence by capillary action. Similarly, capillary action assists in carrying the silver halide solvent solution into the depressions.

Optionally, a surfactant may be applied to the spaced depressions prior to coating the fine-grain emulsion thereon or with the fine-grain emulsion.

The term, "fine-grain emulsion," as used herein is intended to refer to a silver halide emulsion containing grains the size of which would permit a number of grains to be deposited within each depression and also sufficiently small to substantially conform to the contours of the depressions. Preferably, a silver halide emulsion containing grains between about 0.01 and 0.50 μm in diameter is employed. Particularly preferred is a silver halide emulsion having a grain size with an average diameter of about 0.1 μm or less.

Preferably, to keep the silver halide grains of the fine-grain emulsion in suspension prior to depositing them in the depressions, a polymeric binder material, generally gelatin, is employed. It is preferred that the binder to silver ratio be relatively low, since an excessive amount of binder such as gelatin may slow or inhibit the subsequent single grain formation. In addition, excessive binder would occupy space in the depressions that could be taken by silver halide grains or silver halide solvent. Preferably, the gel to silver ratio is about 0.1 or less and more preferably about 0.075. It is also preferred that the fine-grain emulsion be dried in the depressions prior to the next processing step so that subsequent processing steps will not result in the displacement or loss of the fine-grain silver halide emulsion from the depressions.

Subsequent to the deposition of the fine-grain emulsion in the depressions, coalescence of the grains into single effective silver halide grains is preferably accomplished by the application of a solution of silver halide solvent so that in each depression there occurs a partial dissolution of the grains. Sufficient silver halide solvent must be employed to achieve suitable single effective grain formation as determined by photographic speed, $D_{min}$, $D_{max}$ and the like, but an excessive amount should be avoided so that the fine-grain emulsion will not be removed from the depressions. In the case of partial coalescence, e.g., by applying insufficient silver halide solvent, single effective grains are not formed in all of the depressions, but rather in at least some depressions a plurality of subunits are formed.

Any suitable silver halide solvent known to the art and combinations thereof may be employed in the practice of the present invention. As examples of such solvents mention may be made of the following: soluble halide salts, e.g., lithium bromide, potassium bromide, lithium chloride, potassium chloride, sodium bromide, sodium chloride; sodium thiosulfate, sodium sulfate, ammonium thiocyanate, potassium thiocyanate, sodium thiocyanate; thioethers such as thiodiethanol; ammonium hydroxide; organic silver complexing agents, such as ethylene diamine and higher amines.

As disclosed and claimed in application Ser. No. 298,638, the solution of silver halide solvent preferably contains any suitable silver salt which is not photographically detrimental. Preferably, silver thiocyanate or a silver halide such as silver chloride or silver bromide, is employed. In one embodiment, the silver halide solvent solution is saturated with the silver salt.

For ease of application a small amount of polymeric binder material, preferably gelatin, is employed in the solution of silver halide solvent. Suitable amounts of binder range from about 0 to 10%.

The hydrophilic layer which overlies the hydrophobic layer during coalescence functions as the cover sheet described in applications Ser. Nos. 298,640 and 298,638, i.e., it insures that coalescence occurs only in the depressions and controls the amount of silver halide solvent in each depression.

After heating the partially dissoved grains, an optional cooling step is also preferred prior to removing the hydrophilic polymeric layer in order to further assist the coalescence of the fine-grain emulsion into single effective grains in each depression and to assist separation and promote gelation of the gelatin.

After separation of the layers a pattern of silver halide grains, preferably single effective silver halide grains, in a predetermined pattern corresponding to the predetermined spaced array of depressions is retained on the hydrophilic layer.

Preferably, the solution of silver halide solvent is applied to a nip formed by the hydrophilic layer and the hydrophobic layer. In the case of separate coalescence and transfer, the solution of silver halide solvent is applied to a nip formed by a first and second hydrophobic layer, and the thus-formed laminate is passed through pressure-applying rollers.

As examples of suitable hydrophilic layers, mention may be made of gelatin or polyvinyl alcohol. The hydrophilic layer may be self-supporting or carried on a suitable support such as cellulose triacetate.

The term "hydrophilic" is also intended to include initially hydrophobic surfaces rendered hydrophilic, by, e.g., flame treatment.

The relief pattern may be in the form of a drum, belt or the like to permit reuse for a continuous, or step-and-repeat, grain-forming procedure.

The following Examples illustrate the novel process of the present invention.

EXAMPLE 1

A fine-grain photosensitive silver iodobromide emulsion (4 mole % I, gelatin/Ag ratio of 0.075, grain diameter about 0.1 μm) was slot-coated onto a polyester base carrying a layer of cellulose acetate butyrate embossed with depressions about 1.8 μm in diameter, about 1 μm in depth with center-to-center spacing of about 2.2 μm. The emulsion contained a combination of AEROSOL OT (dioctyl ester of sodium sulfosuccinic acid) American Cyanamid Co, Wayne, N.J., and MIRANOL J2M-SF (dicarboxcyclic caprylic derivative sodium salt) Miranol Chemical Co., Inc., Irvington, N.J., in a 1 to 3 ratio by weight, respectively, at about 0.1% concentration by weight, based on the weight of the emulsion. The emulsion-coated embossed base was then dried.

The silver halide solvent solution was prepared by adding 1 g of silver thiocyanate to 200 ml of a 9% ammonium thiocyanate solution in water, and heating the resulting mixture to 50° C. for about 15 min. The mixture was then cooled to 25° C. and the excess silver thiocyanate was removed by filtering with a 0.2 μm filter, and the filtrate was diluted 1:1 by volume with a 2% gelatin solution.

The emulsion-coated embossed base and a layer of 25 mg/ft$^2$ of gelatin carried on a subcoated cellulose triacetate support were passed through rubber rollers with pressure applied thereto while the silver halide solvent solution was applied to the nip formed by the emulsion-coated embossed base and the gelatin-coated cover sheet. The thus-formed lamination was heated for 2 min. at 67° C. and then cooled for about 2 min. at about −20° C. and then the gelatin-coated cover sheet was detached from the embossed base. A regular spaced array of silver halide grains was observed partially embedded in the gelatin layer. FIG. 1 is an electron micrograph at 2,000× magnification showing the gelatin layer and the grains.

EXAMPLE 2

A fine-grain photosensitive silver iodobromide emulsion (4 mole % I, gelatin/Ag ratio of 0.1, grain diameter about 0.1 μm or less) was slot-coated onto a polyester base carrying a layer of cellulose acetate butyrate embossed with depressions about 0.9 μm in diameter, about 0.9 μm in depth with center-to-center spacing of about 1.2 μm. The emulsion contained surfactants as described in Example 1 to facilitate coating. The emulsion-coated embossed base was then dried.

Figure 2:
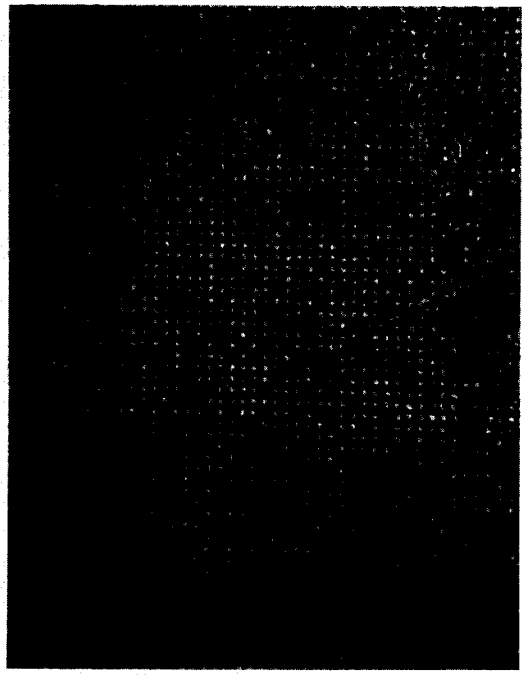
FIG. 2 is a light micrograph at 1,600× of another embodiment of a photosensitive element of the present invention.

The emulsion-coated embossed base was laminated to a polyester sheet having a hydrophilic gelatin subcoat by passing the base and the sheet between stainless steel rollers while the silver halide solvent solution was applied to the nip formed by said polyester sheet and embossed base. The silver halide solvent solution comprised an ammonium hydroxide solution containing 17% ammonia, 0.5% hydroxyethyl cellulose (NATROSOL 250HH, sold by Hercules Co., Wilmington, Del.) and 0.5% surfactant (reaction product of nonylphenol and glycidol, Olin 10G, sold by Olin Corp., Stamford, Conn.). After one minute, the polyester sheet was detached from the embossed base. A silver halide deposit exhibiting diffraction colors was visible in the hydrophilic subcoat of the polyester sheet. FIG. 2 is a light micrograph at 1,600× magnification showing single effective silver halide grains on the polyester sheet arrayed and spaced according to the pattern of the embossed base.

EXAMPLE 3

A fine-grain photosensitive silver iodobromide emulsion (4 mole % I, gelatin/Ag ratio of 0.075, grain diameter about 0.1 μm) was slot-coated onto a polyester base carrying a layer of cellulose acetate butyrate embossed with depressions about 1.8 μm in diameter, about 1 μm in depth with center-to-center spacing of about 2.2 μm. The emulsion contained surfactants as described in Example 1 to facilitate coating. The emulsion-coated embossed base was then dried.

Figure 3:
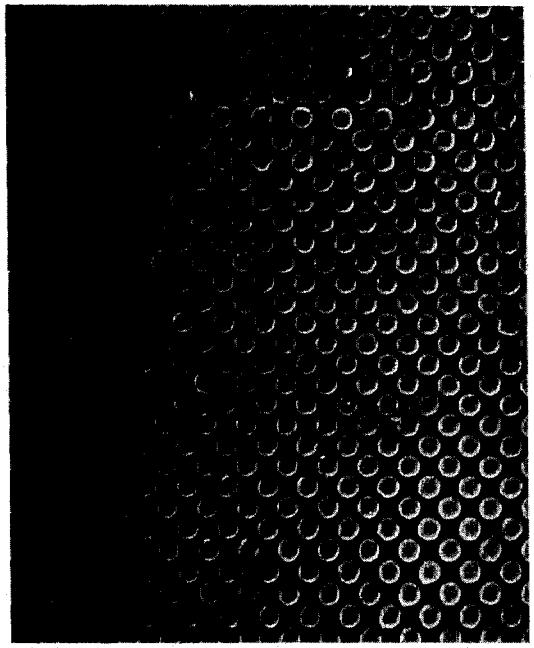
FIG. 3 is an electron micrograph at 2,000× magnification of still another embodiment of a photosensitive element of the present invention.
Figure 4:
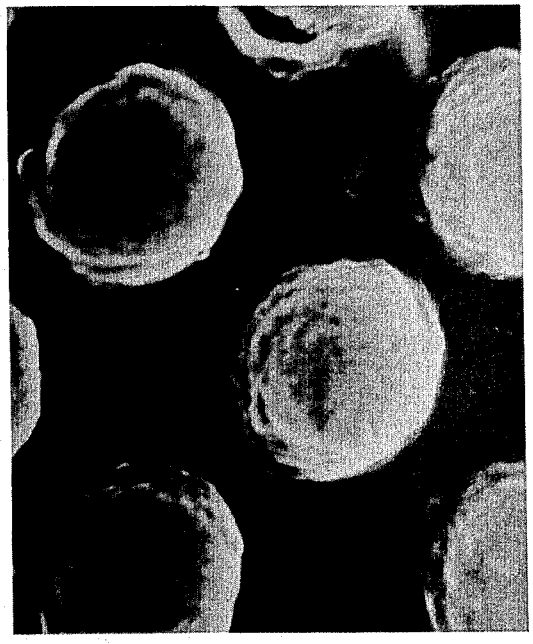
FIG. 4 is an electron micrograph at 20,000× magnification of the element of FIG. 3.

The emulsion-coated embossed base and a cover sheet of cellulose acetate butyrate support (13 mil) carrying a 0.7 mil coating of polyvinyl alcohol were passed through rubber rollers with pressure applied thereto while a silver halide solvent solution was applied to the nip formed by the emulsion-coated embossed base and the cover sheet. The silver halide solvent solution comprised 4.5% ammonium thiocyanate solution in water, saturated with silver thiocyanate, and 1% gelatin. The thus-formed lamination was heated for 2 min. at 55° C. and then cooled for about 2 min. at about −20° C. and then the cover sheet was detached from the embossed base. A regular spaced array of silver halide grains was observed partially embedded in the polyvinyl alcohol layer. FIG. 3 is a scanning electron micrograph at 2,000× magnification showing the polyvinyl alcohol layer and the grains. FIG. 4 is a scanning electron micrograph at 20,000× magnification showing the single effective grains partially embedded in the polyvinyl alcohol layer.

The photographic element of the present invention may be chemically sensitized by conventional sensitizing agents known to the art and which may be applied at substantially any stage of the process, e.g., during or subsequent to coalescence and prior to spectral sensitization.

Preferably, spectral sensitization of the photosensitive elements of the present invention may be achieved by applying a solution of a spectral sensitizing dye to the thus-formed single effective silver halide grains. This is accomplished by applying a solution of a desired spectral sensitizing dye to the finished element. However, the sensitizing dye may be added at any point during the process, including with the fine-grain emulsion or silver halide solvent solution. In a preferred embodiment, the spectral sensitizing dye solution contains a polymeric binder material, preferably gelatin.

Additional optional additives, such as coating aids, hardeners, viscosity-increasing agents, stabilizers, preservatives, and the like, also may be incorporated in the emulsion formulation.

What is claimed is:

1. A method for forming a photosensitive element comprising a support carrying photosensitive silver halide grains in a predetermined spaced array which comprises at least partially coalescing fine-grain silver halide in a plurality of depressions in a hydrophobic layer, superposing a hydrophilic layer and said hydrophobic layer, and thereafter separating said hydrophilic layer from said hydrophobic layer, whereby silver halide grains are retained on said hydrophilic layer in a pattern corresponding substantially to the pattern of said spaced depressions.

2. The method of claim 1 wherein said fine-grain silver halide is coalesced to single effective grains.

3. The method of claim 1 wherein said hydrophilic layer is superposed subsequent to said coalescence.

4. The method of claim 1 wherein said hydrophilic layer is superposed substantially contemporaneously with said coalescence.

5. The method of claim 3 which includes the step of washing said grains prior to superposing said hydrophilic layer.

6. The method of claim 3 which includes the step of spectrally sensitizing said grains prior to superposing said hydrophilic layer.

7. The method of claim 3 which includes the step of chemically sensitizing said grains prior to superposing said hydrophilic layer.

8. The method of claim 1 wherein said hydrophilic layer includes gelatin.

9. The method of claim 1 wherein said hydrophilic layer consists essentially of gelatin.

10. The method of claim 1 wherein said hydrophilic layer is polyvinyl alcohol.

11. The method of claim 9 wherein said gelatin is carried on a support.

12. The method of claim 1 wherein said hydrophobic layer is cellulose acetate butyrate.

13. The method of claim 1 which comprises carrying out said coalescence with a solution of a silver halide solvent.

14. The method of claim 13 wherein said solution of silver halide solvent contains a silver salt.

15. The method of claim 1 which includes the step of depositing a fine-grain silver halide emulsion in said spaced depressions.

16. The method of claim 15 wherein said fine-grain emulsion comprises grains about 0.01 to 0.50 μm in average diameter.

17. The method of claim 16 wherein said fine-grain emulsion comprises grains about 0.1 μm or less in diameter.

18. The method of claim 15 wherein said fine-grain emulsion has a binder to silver ratio of about 0.1 or less.

19. The method of claim 18 wherein said binder to silver ratio is about 0.075.

20. The method of claim 18 wherein said silver halide solvent is ammonium thiocyanate.

21. The method of claim 14 wherein said silver salt is silver thiocyanate.

22. The method of claim 14 wherein said silver salt is silver bromide.

23. The method of claim 13 wherein said solution of silver halide solvent includes a polymeric binder material.

24. The method of claim 23 wherein said polymeric binder material is gelatin.

25. The method of claim 1 wherein said coalescence includes the application of heat subsequent to the application of said solution of silver halide solvent.

26. The method of claim 25 which includes the step of cooling subsequent to said application of heat.

27. A method for forming a photosensitive element comprising a support carrying a plurality of single effective silver halide grains in a predetermined spaced array which comprises the following steps:

(a) depositing a fine-grain silver halide emulsion in a plurality of predetermined spaced depressions in a hydrophobic layer;

(b) applying a solution of silver halide solvent in an amount sufficient to partially dissolve said silver halide grains in each depression;

(c) coalescing said grains to a single effective silver halide grain in substantially each depression;

(d) superposing said hydrophobic layer and a hydrophilic layer; and (e) separating said hydrophilic layer from said hydrophobic layer whereby the thus-formed single effective silver halide grains are retained on said hydrophilic layer in a pattern corresponding substantially to said pattern of said spaced depressions.

28. The method of claim 27 which includes the step of superposing said hydrophilic layer over said depressions substantially contemporaneously with the application of said solution of silver halide solvent.

29. The method of claim 27 which includes the step of superposing said hydrophilic layer over said depressions subsequent to said coalescence.

30. The method of claim 29 which includes the step of washing said grains prior to superposing said hydrophilic layer.

31. The method of claim 29 which includes the step of spectrally sensitizing said grains prior to superposing said hydrophilic layer.

32. The method of claim 29 which includes the step of chemically sensitizing said grains prior to superposing said hydrophilic layer.

33. The method of claim 27 wherein said solution of silver halide solvent is disposed in a nip formed by said hydrophilic layer and said hydrophobic layer and applying pressure to said hydrophilic layer and said hydrophobic layer.

34. The method of claim 33 wherein said pressure is applied by passing said hydrophilic layer and said hydrophobic layer between pressure applying rollers.

35. The method of claim 27 wherein said coalescence includes the application of heat subsequent to said application of silver halide solvent.

36. The method of claim 35 which includes the step of cooling subsequent to said application of heat.

37. The method of claim 27 wherein said hydrophilic layer includes gelatin.

38. The method of claim 27 wherein said hydrophilic layer consists essentially of gelatin.

39. The method of claim 27 wherein said hydrophilic layer is polyvinyl alcohol.

40. The method of claim 27 wherein said hydrophobic layer is cellulose acetate butyrate.

41. The method of claim 37 wherein said gelatin is carried on a support.

42. The method of claim 27 wherein said solution of silver halide solvent contains a silver salt.

43. The method of claim 27 wherein said fine-grain emulsion comprises grains about 0.01 to 0.50 μm in average diameter.

44. The method of claim 43 wherein said fine-grain emulsion comprises grains about 0.1 μm of less in diameter.

45. The method of claim 27 wherein said fine-grain emulsion has a binder to silver ratio of about 0.1 or less.

46. The method of claim 45 wherein said binder to silver ratio is about 0.075.

47. The method of claim 27 wherein said silver halide solvent is ammonium thiocyanate.

48. The method of claim 42 wherein said silver salt is silver thiocyanate.

49. The method of claim 42 wherein said silver salt is silver bromide.

50. The method of claim 27 wherein said solution of silver halide solvent includes a polymeric binder material.

51. The method of claim 50 wherein said polymeric binder material is gelatin.

* * * * *

UNITED STATES PATENT AND TRADEMARK OFFICE

CERTIFICATE OF CORRECTION

PATENT NO. : 4,353,977

DATED : October 12, 1982

INVENTOR(S) : Arthur M. Gerber, Warren D. Slafer, Vivian K. Walworth

It is certified that error appears in the above-identified patent and that said Letters Patent are hereby corrected as shown below:

Col. 2, line 26, after "be" insert --crystallographically a single crystal but one in which the--;

line 45, after "means," insert --for--.

Signed and Sealed this

*Eighth* Day of *February 1983*

[SEAL]

*Attest:*

GERALD J. MOSSINGHOFF

*Attesting Officer*

*Commissioner of Patents and Trademarks*